US007634326B2

(12) United States Patent
Christman, Jr. et al.

(10) Patent No.: US 7,634,326 B2
(45) Date of Patent: Dec. 15, 2009

(54) SYSTEM AND METHOD FOR FORMING TUFTED PATTERNS

(75) Inventors: William M. Christman, Jr., Hixson, TN (US); Wilton Hall, Ringgold, GA (US)

(73) Assignee: Card-Monroe Corp., Chattanooga, TN (US)

( * ) Notice: Subject to any disclaimer, the term of this patent is extended or adjusted under 35 U.S.C. 154(b) by 697 days.

(21) Appl. No.: 11/531,029

(22) Filed: Sep. 12, 2006

(65) Prior Publication Data

US 2007/0272137 A1 Nov. 29, 2007

Related U.S. Application Data

(60) Provisional application No. 60/802,847, filed on May 23, 2006.

(51) Int. Cl.
*G06F 19/00* (2006.01)

(52) U.S. Cl. ..... 700/131; 700/138; 112/80.01; 112/470.01; 112/475.23

(58) Field of Classification Search ..... 700/130, 700/131, 136, 138; 112/80.01, 470.01, 470.06, 112/475.18, 475.19, 475.23
See application file for complete search history.

(56) References Cited

U.S. PATENT DOCUMENTS

| | | | |
|---|---|---|---|
| 2,213,552 | A | 9/1940 | Scharr |
| 2,842,259 | A | 7/1958 | Hoeselbarth |
| 2,862,465 | A | 12/1958 | Card |
| 2,866,424 | A | 12/1958 | Masland, II |
| 2,879,728 | A | 3/1959 | McCutchen |
| 2,884,881 | A | 5/1959 | Oberholtzer |
| 2,932,181 | A | 4/1960 | MacCaffray, Jr. |
| 2,966,866 | A | 1/1961 | Card |
| 3,067,701 | A | 12/1962 | Wilcox |
| 3,075,482 | A | 1/1963 | Card |
| 3,095,840 | A | 7/1963 | Ballard |

(Continued)

FOREIGN PATENT DOCUMENTS

| | | |
|---|---|---|
| GB | 1126549 | 9/1968 |

(Continued)

OTHER PUBLICATIONS

Super Graphics Product Brochure, Tuftco Corporation, Chattanooga, TN.

(Continued)

*Primary Examiner*—Gary L Welch
*Assistant Examiner*—Nathan E Durham
(74) *Attorney, Agent, or Firm*—Womble Carlyle Sandridge & Rice, PLLC

(57) ABSTRACT

A tufting machine and a method of controlling the tufting machine to form a tufted article having varying pattern effects, such as forming cut and loop pile tufts of yarn in a graphics type pattern, defining a yarn feed effect pattern and a shifting needle bar effect pattern, and combining the two patterns. The yarn feed of the tufting machine is controlled to compensate for pattern shifts while a hook assembly having a series of hooks/loopers and a series of clips independently moveable between extended and retraced positions is selectively controlled to cause a transition from cut pile tufts to loop pile tufts and loop pile tufts to cut pile tufts according to the programmed pattern information.

15 Claims, 10 Drawing Sheets

U.S. PATENT DOCUMENTS

| | | | |
|---|---|---|---|
| 3,095,841 | A | 7/1963 | Ballard et al. |
| 3,103,903 | A | 9/1963 | Broadrick et al. |
| 3,112,721 | A | 12/1963 | Oberholtzer et al. |
| 3,221,683 | A | 12/1965 | Abelsma |
| 3,375,797 | A | 4/1968 | Gaines |
| 3,489,326 | A | 1/1970 | Singleton |
| 3,605,660 | A | 9/1971 | Short |
| 3,709,173 | A | 1/1973 | Greene |
| 3,752,094 | A | 8/1973 | Short |
| 3,835,797 | A | 9/1974 | Franks et al. |
| 3,847,098 | A | 11/1974 | Hammel, Jr. |
| 3,895,355 | A | 7/1975 | Shorrock |
| 3,906,876 | A | 9/1975 | Fitton |
| 3,926,132 | A | 12/1975 | Lear et al. |
| 3,943,865 | A | 3/1976 | Short et al. |
| 3,976,298 | A | 8/1976 | Hinchman |
| 4,111,646 | A | 9/1978 | Buckwalter et al. |
| 4,127,078 | A | 11/1978 | Spanel et al. |
| 4,134,347 | A | 1/1979 | Jolley et al. |
| 4,134,348 | A | 1/1979 | Scott |
| 4,185,569 | A | 1/1980 | Inman |
| 4,193,358 | A | 3/1980 | Woodcock |
| 4,221,317 | A | 9/1980 | Fukada et al. |
| 4,244,309 | A | 1/1981 | Spanel et al. |
| 4,245,794 | A | 1/1981 | Hasegawa et al. |
| 4,267,787 | A | 5/1981 | Fukuda |
| 4,285,285 | A | 8/1981 | Chambers et al. |
| 4,317,419 | A | 3/1982 | Spanel et al. |
| 4,366,761 | A | 1/1983 | Card |
| 4,382,704 | A | 5/1983 | Hendrschk |
| 4,393,793 | A | 7/1983 | Beasley |
| 4,466,366 | A | 8/1984 | Hirotsu |
| 4,469,037 | A | 9/1984 | Bost, Jr. |
| 4,519,332 | A | 5/1985 | Fukuda |
| 4,532,667 | A | 8/1985 | Komesker et al. |
| 4,549,496 | A | 10/1985 | Kile |
| 4,608,935 | A | 9/1986 | Bardsley |
| 4,619,212 | A | 10/1986 | Card et al. |
| 4,660,460 | A | 4/1987 | Fulmer |
| 4,688,497 | A | 8/1987 | Card et al. |
| 4,822,241 | A | 4/1989 | Jarvis et al. |
| 4,829,917 | A | 5/1989 | Morgante et al. |
| 4,856,104 | A | 8/1989 | Stoll et al. |
| 4,856,441 | A | 8/1989 | Kurata |
| 4,864,946 | A | 9/1989 | Watkins |
| 4,867,080 | A | 9/1989 | Taylor et al. |
| 4,870,915 | A | 10/1989 | Bagnall |
| 4,981,091 | A | 1/1991 | Taylor |
| 5,005,498 | A | 4/1991 | Taylor et al. |
| 5,058,518 | A | 10/1991 | Card et al. |
| 5,080,028 | A | 1/1992 | Ingram |
| 5,094,178 | A | 3/1992 | Watkins |
| 5,182,997 | A | 2/1993 | Bardsley |
| 5,205,233 | A | 4/1993 | Ingram |
| 5,285,821 | A | 2/1994 | Fredriksson |
| 5,353,582 | A | 10/1994 | Citterio et al. |
| 5,383,415 | A | 1/1995 | Padgett, III |
| 5,458,075 | A | 10/1995 | Tice et al. |
| 5,461,996 | A | 10/1995 | Kaju |
| 5,526,760 | A | 6/1996 | Ok |
| 5,544,064 | A | 8/1996 | Beckwith |
| 5,544,605 | A | 8/1996 | Frost |
| 5,549,064 | A | 8/1996 | Padgett, III |
| 5,575,228 | A | 11/1996 | Padgett, III et al. |
| 5,588,383 | A | 12/1996 | Davis et al. |
| 5,622,126 | A | 4/1997 | Card et al. |
| 5,662,054 | A | 9/1997 | Bardsley |
| 5,738,030 | A | 4/1998 | Ok |
| 5,743,200 | A | 4/1998 | Miller et al. |
| 5,743,201 | A | 4/1998 | Card et al. |
| 5,794,551 | A | 8/1998 | Morrison et al. |
| 5,806,446 | A | 9/1998 | Morrison et al. |
| 5,899,152 | A | 5/1999 | Bardsley et al. |
| 5,983,815 | A | 11/1999 | Card |
| 6,009,818 | A | 1/2000 | Card et al. |
| 6,105,522 | A | 8/2000 | Kato |
| 6,155,187 | A | 12/2000 | Bennett et al. |
| 6,213,036 | B1 | 4/2001 | Slattery |
| 6,244,203 | B1 | 6/2001 | Morgante et al. |
| 6,260,493 | B1 | 7/2001 | Dean |
| 6,263,811 | B1 | 7/2001 | Crossley |
| 6,283,053 | B1 | 9/2001 | Morgante et al. |
| 6,439,141 | B2 | 8/2002 | Morgante et al. |
| 6,446,566 | B1 | 9/2002 | Bennett et al. |
| 6,502,521 | B2 | 1/2003 | Morgante et al. |
| 6,508,185 | B1 | 1/2003 | Morgante et al. |
| 6,516,734 | B1 | 2/2003 | Morgante et al. |
| 6,550,407 | B1 | 4/2003 | Frost et al. |
| 6,758,154 | B2 | 7/2004 | Johnston |
| 6,807,917 | B1 | 10/2004 | Christman et al. |
| 6,834,601 | B2 | 12/2004 | Christman et al. |
| 6,877,449 | B2 | 4/2005 | Morgante et al. |
| 7,007,617 | B2 | 3/2006 | Johnston |
| 7,096,806 | B2 | 8/2006 | Card et al. |
| 2002/0037388 | A1 | 3/2002 | Morgante et al. |
| 2004/0187268 | A1 | 9/2004 | Johnston |
| 2006/0070564 | A1 | 4/2006 | Smith et al. |

FOREIGN PATENT DOCUMENTS

| | | |
|---|---|---|
| GB | 1363974 | 7/1972 |
| GB | 1 507 166 | 5/1975 |
| GB | 2 002 040 | 7/1978 |
| GB | 2002828 | 7/1978 |
| GB | 2186297 | 7/1987 |
| GB | 2354263 | 4/2000 |
| GB | 2367305 | 7/2003 |
| WO | WO 01/20069 | 3/2001 |
| WO | WO 2005/054561 | 6/2005 |

OTHER PUBLICATIONS

CAM with Encore DMC Operator's Manual, Tuftco Corporation, Chattanooga, TN, 1996.
CP2100 Series Yarn Feed/Shift Compensation System Product Brochure, Card-Monroe Corp, Chattanooga, TN.
Tuft Program, Versin 1.20, NedGraphics.
Command Performance 2002 Instruction Manual, Version 3.12, Card-Monroe Corp. Chattanooga, TN.
Tufting Machine Schematic, Card-Monroe Corp., Chattanooga, TN.
CMC Yarntronics Brochure, Card-Monroe Corp., Chattanooga, TN.
Scroll Graphics for One and Only Pattern Brochure, Tuftco Corp., Chattanooga, TN.
Encore Computer Controlled Tufting and Management Information System Brochure, Tuftco Corp., Chattanooga, TN.
MTInnovation Brochure, Modern Techniques, Inc., Ringgold, Georgia.
Cobble Blackburn Limited Order and Contract, Jan. 1986.
Zieseniss Tufting Machine Operational Manual.
Cobble Tufting Machines, L.P. Scroll, 1985/1986.
LPIII Low Profile Scroll by Cobble, 1985/1986.
Tuftco Corporation Split Rainbow Pattern System Brochure.
Tuftco Corporation Multi-Media PC-Control System Brochure.
"Automation Comes to Paris," Carpet & Rug, 1987.
"Carpet Manufacturing Represented at Textile Machinery Exhibition," Carpet Manufacturer International ITMA 87 Preview, Aug. 1987.
Encore DMC Digital Motor Control System Brochure, Tuftco Corporation, Chattanooga, TN.
Tuftco "Encore" Yarn Feed Control Brochure, Tuftco Corporation, Chattanooga, TN.

SYSTEM AND METHOD FOR FORMING TUFTED PATTERNS

CROSS-REFERENCE TO RELATED APPLICATIONS

This application claims the benefit of U.S. Provisional Application Ser. No. 60/802,847 , filed May 23, 2006 , entitled "System and Method for Forming Tufted Patterns," the entire contents of which is hereby incorporated by reference as if presented herein in its entirety.

FIELD OF THE INVENTION

The present invention generally relates to systems and methods for forming tufted patterns, and more particularly to a system and method for designing and forming tufted patterns incorporating a variety of different pattern effects.

BACKGROUND OF THE INVENTION

Tufting machines are widely used for manufacturing tufted pile fabrics, such as carpeting. During a tufting operation, a plurality of yarn carrying needles pass though a heavy fabric backing to form loops of yarn below the fabric backing. Loopers or hooks located below the fabric backing are oscillated so as to capture and hold the loops of yarn so that when the needles are withdrawn from the fabric, the loops are held below the fabric backing to form loop pile tufts. Additionally, tufting machines can include knives for cutting the loops of yarns on the loopers or hooks to form cut pile tufts. Conventional level cut loop type tufting machines also can have hundreds of clips that are moveable into engagement with the hooks/loopers to control formation of loop and cut pile tufts in the backing, each of the clips generally being located below and/or behind one of the hooks and moved to an engaging position by an associated actuator. After the yarn is released from the hook or cut by a knife, the fabric can be advanced so that the yarn carrying needles can create the next set of loops in the backing. As a result, the tufting machine can selectively generate both loop and cut pile tufts in the backing material.

Alternatively, tufting machines can be provided with various types of yarn feed control systems, such as scroll or roll attachments, as well as including one or two transversely shifting needle bars for creating various sculptured or graphics patterns. For example, single end yarn feed systems now have been developed for controlling the feeding of individual yarns to create increasingly complex patterns for carpets and rugs.

SUMMARY OF THE INVENTION

Briefly described, in accordance with one example embodiment of the present invention, a tufting machine is provided having a frame with a base, a head portion, and a yarn feed attachment mounted on the head portion of the tufting machine. The yarn feed attachment generally includes yarn feed controls and a series of rolls that feed yarns to the needles of the tufting machine. A looper assembly is mounted below the bed of the tufting machine and includes a series of spaced hooks or loopers and a series of clips for engaging the hooks/loopers to control the formation of cut and loop pile tufts. The looper assembly further can include a level cut loop looper or hook assembly having a series of actuators that are selectively actuated for moving associated clips into and out of engagement with one or more hooks/loopers to form the cut or loop pile tufts.

During operation of the method of the present invention, the operator will create a first pattern, such as a roll, scroll or other yarn feed effect pattern at a design center. Thereafter, the operator will create a second pattern, typically a graphics or enhanced graphics type pattern, after which the operator will draw in a cam motion representing the needle bar stepping or shifting motion for the pattern, typically with multiple different colors being used to represent different pile heights for the graphics pattern effects. After creating the two separate patterns, the yarn feed effect pattern (pattern 1) will be copied into the graphics or enhanced graphics pattern (pattern 2) to create a combined pattern (pattern 3), which is then saved. This combined pattern will then be loaded into a control system for the tufting machine for implementation.

During operation of the tufting machine, the tufting machine will follow the pattern steps for the combined pattern until a shifting or stepping movement of the needle bar of the tufting machine is required. While shifting, the tufting machine control will effectively split the combined pattern into its separate pattern components or steps and will shift the yarn feed component of the combined pattern (i.e., the pattern 1 step or component) internally in opposition to the shifting of the needle bar, in order to compensate for the shifting of the needle bar and to keep the pattern in effect "running straight" on the machine. The resultant tufted article thus can have a variety of pattern effects formed therein, including, for example, scroll, roll, and/or level-cut-loop type patterns combined with a graphics or enhanced graphics type pattern to create a wide variety of designs and appearances.

Various objects features and advantages of the present invention will be apparent to those skilled in the art upon the review of the following detailed description when taken in conjunction with the accompanying drawings.

DETAILED DESCRIPTION OF THE INVENTION

Figure 1:
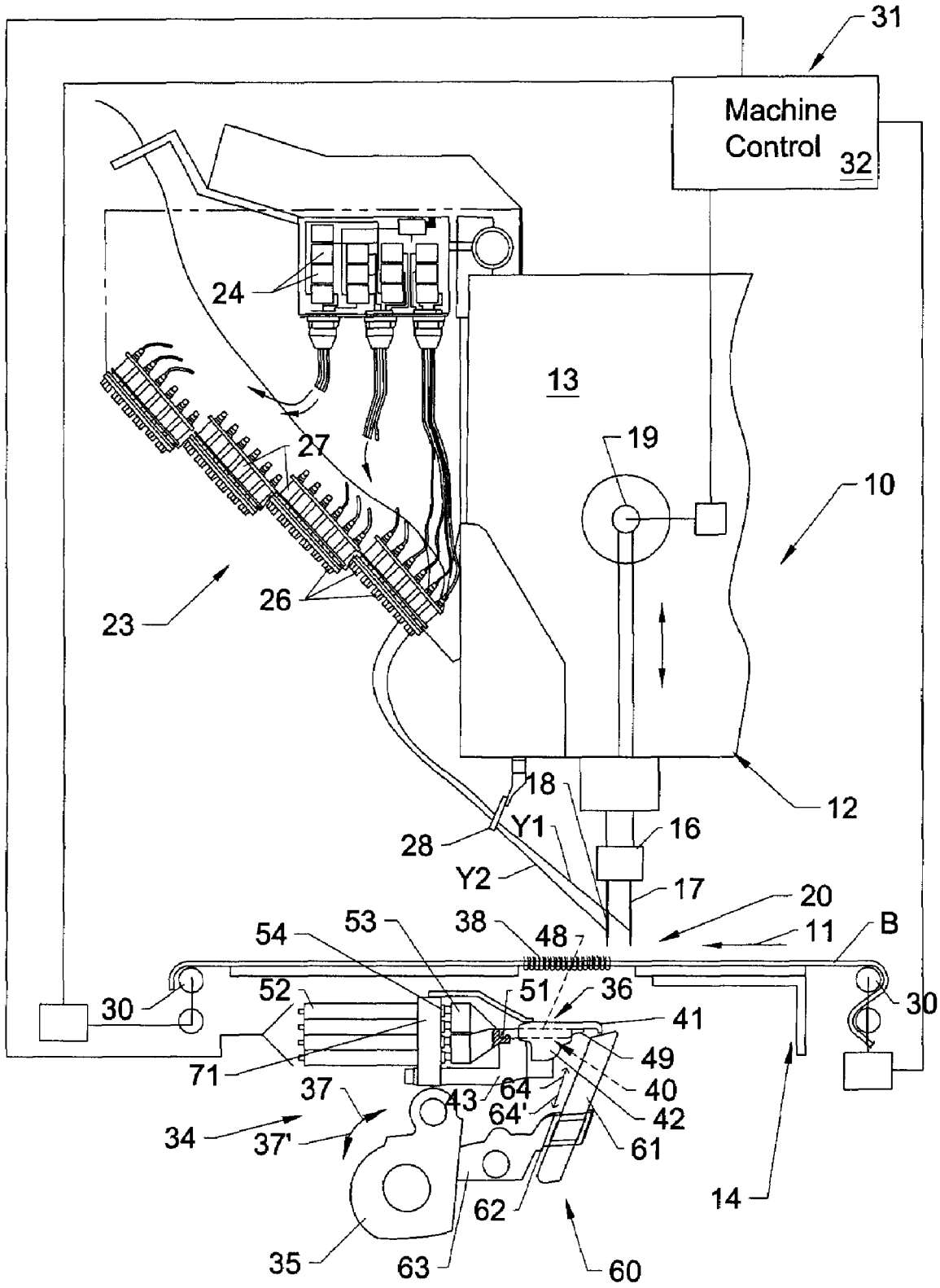
FIG. 1 is a partial and side elevational view of a tufting machine with a level-cut-loop hook assembly and yarn feed attachment according to the present invention.

In accordance with one example embodiment of the present invention, as generally illustrated in FIGS. 1-5D, a tufting machine for forming tufts of yarn in a fabric backing material to form a tufted article having a variety of different pattern effects therein, is provided. As shown in FIG. 1, the tufting machine 10 defines a tufting path 11 along which the backing material B moves as it passes through the tufting machine, and generally includes a frame 12 having a head or upper portion 13 attached to a base 14. At least one needle bar 16 carrying spaced rows of needles 17/18 are driven off a main shaft 19 of the tufting machine and define a tufting zone 20 therebeneath. The needle bar 16 can be a single needle bar having staggered rows of needles 17 and 18 therealong (as shown) and being shiftable under control of a shift mechanism 21 (FIG. 2), such as a Smartstep™ shifter, as manufactured by Card-Monroe Corp., or other, similar shifter for shifting the needle bar transversely across the tufting zone as indicated by arrows 22 and 22' in FIG. 2. Alternatively, a pair of shiftable needle bars 16, each carrying a row of needles 17 or 18 in spaced series therealong, also can be used. As shown in FIG. 1, the tufting machine further will include one or more yarn feed mechanism or attachments 23 mounted along the upstream or downstream side of the frame of the tufting machine.

Each yarn feed attachment 23 generally includes a series of yarn feed controls or drives 24 controlling the operation of a series of feed rolls 26 driven by motors 27 to feed a series of yarns (shown at Y1 and Y2) through a guide 28 to selected ones of the needles 17 and 18. It further will be understood that the yarn feed attachment 23 can comprise various types of pattern yarn feed mechanisms, including computer controlled, motor driven yarn feed rolls or other conventional yarn feed/drive mechanisms such as roll and scroll type pattern attachments that control the feeding of all the yarns across the width of the tufting machine to their respective needles. Other known types of yarn feed mechanisms that can be used include systems such as Card-Monroe Corp.'s Quick-Thread™, Enhanced Graphics™, Multi-Pile Height Scroll, and/or Infinity™ yarn feed systems having multiple feed rolls for controlling the feeding of specific sets or repeats of yarns to selected needles, including the use of individual yarn feed rolls for controlling the feeding of single yarns or pairs of yarns to each respective needle. For example, U.S. Pat. Nos. 6,009,818; 5,983,815; and 6,807,917 disclose pattern yarn feed devices for controlling the feeding and distribution of the yarns, while U.S. Pat. No. 5,979,344 discloses a precision drive system for driving various operative elements of the tufting machine, all of which systems can be used with the present invention and are incorporated herein by reference in their entireties.

As indicated in FIG. 1, The backing material B is fed through the tufting zone 20 along a feed direction/path in the direction of arrow 11 by backing feed rolls 30 for engagement by the needles 17/18 to insert the yarns Y1 and Y2 therein and form cut and/or loop pile tufts of yarns in the backing material B. During such a tufting operation, the operative elements of the tufting machine further generally can be monitored and controlled by a tufting machine control system 31. The control system 31, such as a "Command Performance" tufting machine control manufactured by Card-Monroe Corp., typically will include a controller or computer/processor 32 that can be programmed with pattern information and which monitors and controls the tufting machine elements, such as operation of the yarn feed attachment(s) 23, backing feed rolls 30, shifting mechanism, and a looper assembly 34 discussed below. The system controller can control the tufting machine in accordance with the programmed pattern instructions or can receive and execute and/or store pattern information from a design center (not shown) separate from or which can be included as part of the control system 31.

Figure 2:
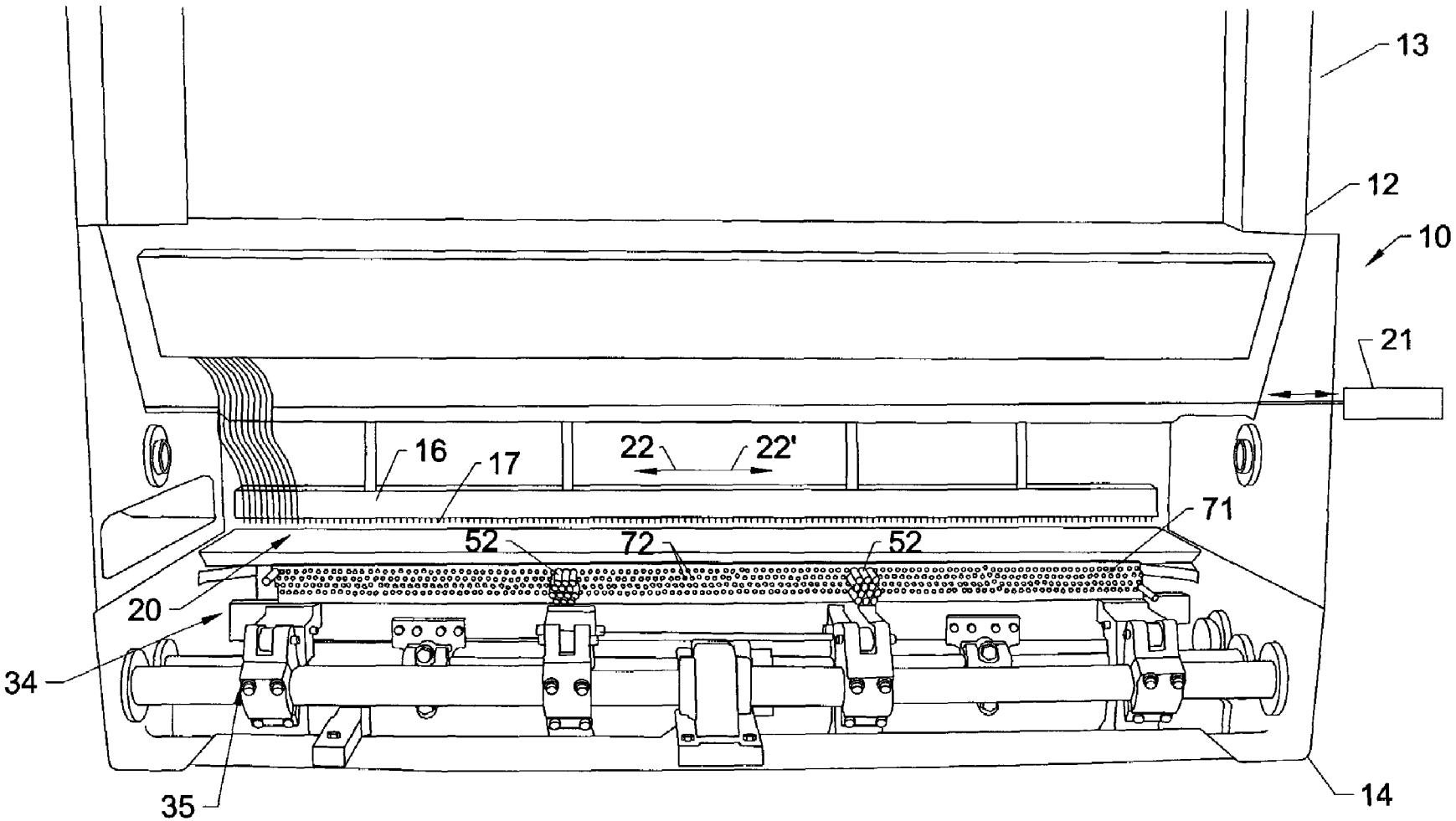
FIG. 2 is a side view of the tufting zone of the tufting machine of FIG. 1 incorporating the looper assembly of the present invention.
Figure 3A:
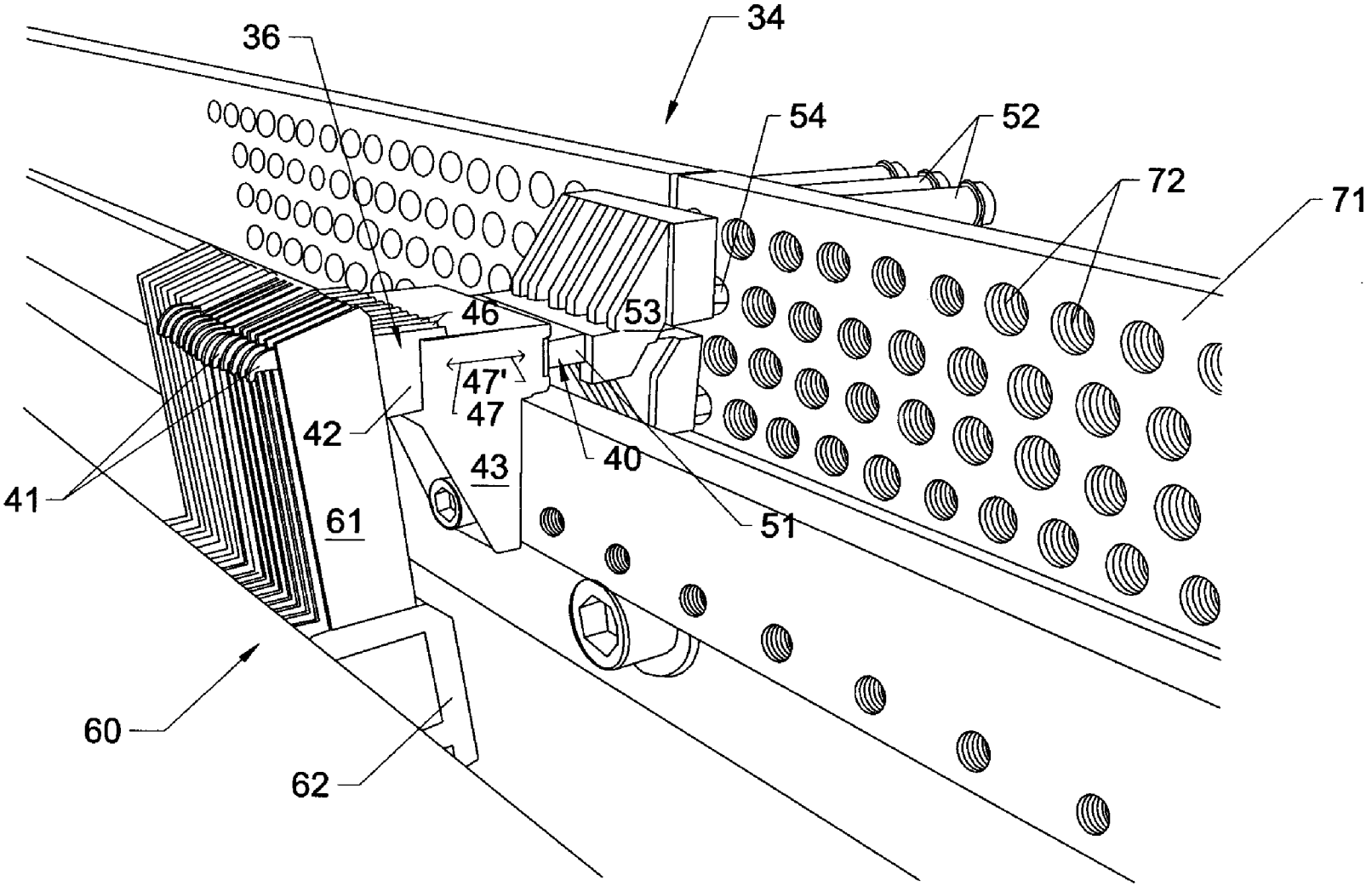
FIG. 3A-3B are perspective views of a portion of the level-cut-loop looper or hook assembly gates and hooks.
Figure 3B:
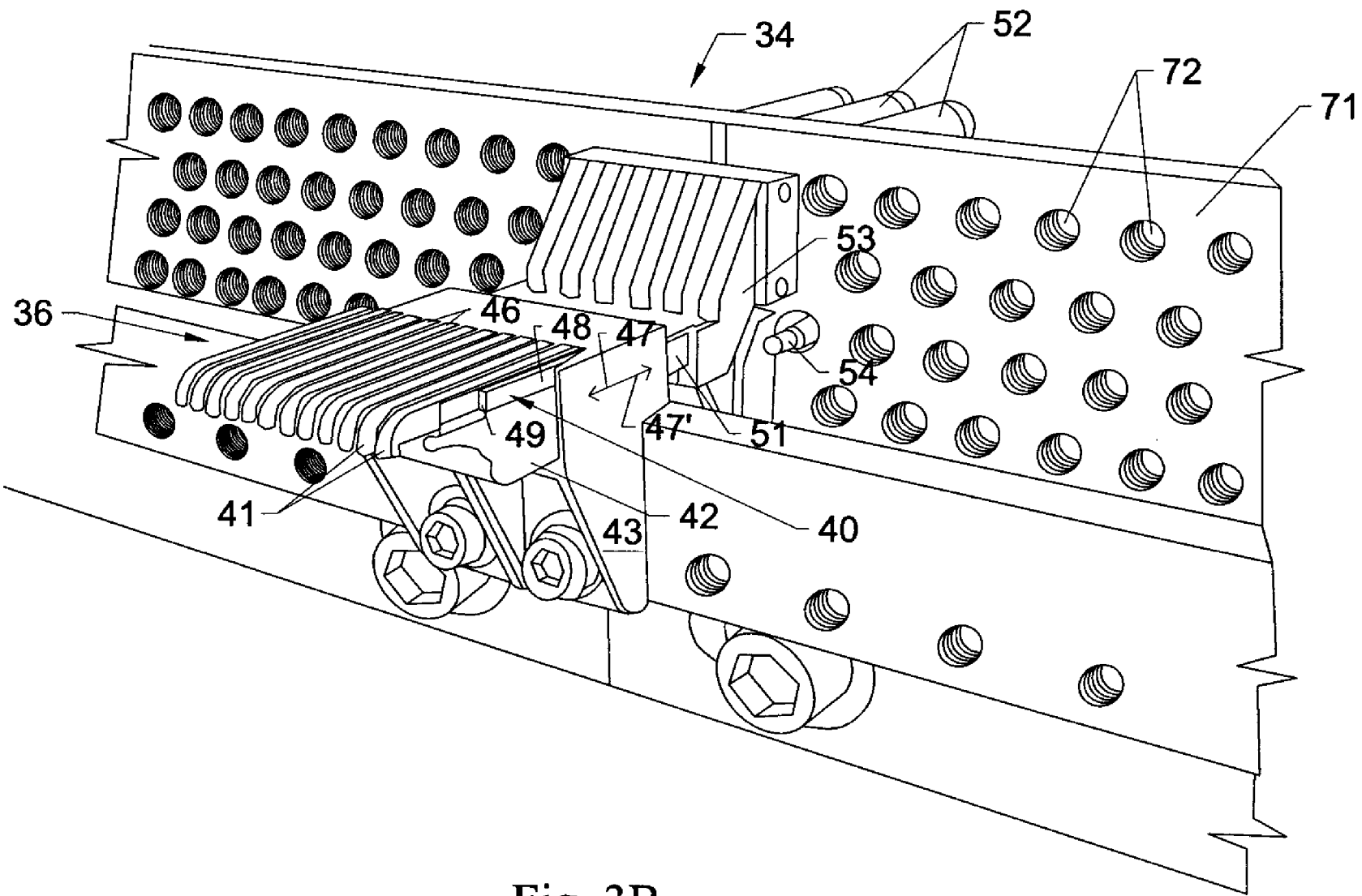

As shown in FIGS. 1 and 2, the looper assembly 34 is mounted below the bed and tufting zone of the tufting machine and generally includes a reciprocating drive mechanism 35 for moving a series of spaced hooks or loopers 36 in a reciprocating motion, as indicated in FIG. 1 by arrows 37/37' toward and away from the needles 17/18, as the needles penetrate the backing material to form loops 38 of yarns Y1/Y2 in the backing material B. The looper assembly 34 further can include a level cut loop hook or looper assembly having a series of level cut loop loopers or hooks 36 (as shown in FIGS. 3A-3B) each with a clip 40 for engaging loops of yarn Y1/Y2 captured by the loopers 36. Each of the loopers 36 generally will include a front or bill portion 41 extending forwardly from a rear, body portion 42 that is mounted within a support block or holder 43 mounted on an elongated hook or looper bar 44. Slots 46 generally are formed through the blocks 43, as generally illustrated in FIGS. 3A-3B, which the clips 40 are received and are selectively moveable through the blocks 43 along passages extending adjacent the hooks/loopers 36 in the direction of arrows 47 and 47', between open/extended and closed/retracted positions as needed to form loop and/or cut pile tufts.

The clips 40 (FIG. 3B) each include an elongated body 48 generally formed from metal, plastic, composites, or other similar materials, and have a first, proximal end 49, and a second, distal end 51 that extends through the block 43 and is connected to an associated actuator(s) 52 by a connector or gate 53 that includes an actuator connector portion configured to be connected to one or more output or drive shafts 54 of the associated actuator(s) 52. The actuators can include hydraulic, pneumatic, or other type of cylinders, servo-motors, solenoids, or other, similar drive mechanisms for driving the clips between their extended and retracted positions.

As further illustrated in FIGS. 1 and 3A-3B, a series of knife assemblies 60 also typically are provided adjacent the hooks/loopers 36 of the looper assembly 34. The knife assemblies 60 generally include a knife or cutting blade 61 mounted in a holder 62 connected to a reciprocating drive mechanism 63 (FIG. 1). The knives are reciprocated into engagement with the hooks/loopers to cut the loops 38 of yarn selectively captured thereon, as indicated by arrows 64 and 64', to form a series of cut pile tufts in the backing material B as it passes through the tufting zone as shown in FIG. 1.

As indicated in FIGS. 1 and 2, in one example embodiment, the actuators 52 generally will include pneumatic or hydraulic cylinders that are connected via conduits or an air/fluid supply line to an air or other fluid a source or supply of a fluid media such as air, hydraulic fluids, or other fluid media. Alternatively, other types of actuators, such as servo-motors or other types of motors, solenoids, or other, similar drives also can be used. The actuators 52 (FIG. 2) generally are mounted along a support block or bar 71, with the output or drive shafts or cylinder rods 54 extending through openings or ports 72 formed therein. The actuators are selectively controlled by the control system 31 (FIG. 1) for opening and closing the valves to turn on/off the supply of air to the actuators 52 for the connectors/clips as needed for actuating or extending and retracting specific, selected individual connectors/clips in order to form a desired tufted cut/loop pattern in the backing material. In addition, the looper assembly can include clips for cut/loop loopers and can be mounted on a looper or hook bar or module in a manner to enable replacement of individual hooks or loopers as needed, with the clips tending to be retained in place by the engagement of the gates with the clips.

One example embodiment of the method of use and operation of the tufting machine according to the principles of the present invention is illustrated in FIGS. 4A-5D, which illustrates the operational steps and various pattern designs created/followed to create a tufted article having a variety of differing pattern effects, such as having a combination of "level cut loop" and "Enhanced Graphics" pattern effects in a single tufted article. According to the present invention, at the start of the pattern cycle (Step 100 in FIG. 4A), a user or operator will create a first pattern (Pattern 1) at a design center (Step 101). In the embodiment illustrated herein in Step 101, the first pattern created typically will be a yarn feed effect pattern, which can include a scroll, roll, "single-end," or similar pattern, produced on a first screen (Screen 1). As an example, the operator can draw a scroll pattern, such as the pattern illustrated in FIG. 5A, at the design center using design center software such as "Texcele" or "Vision Tuft Professional" Design Center software from NedGraphics, or other similar design center software.

Figure 5A:
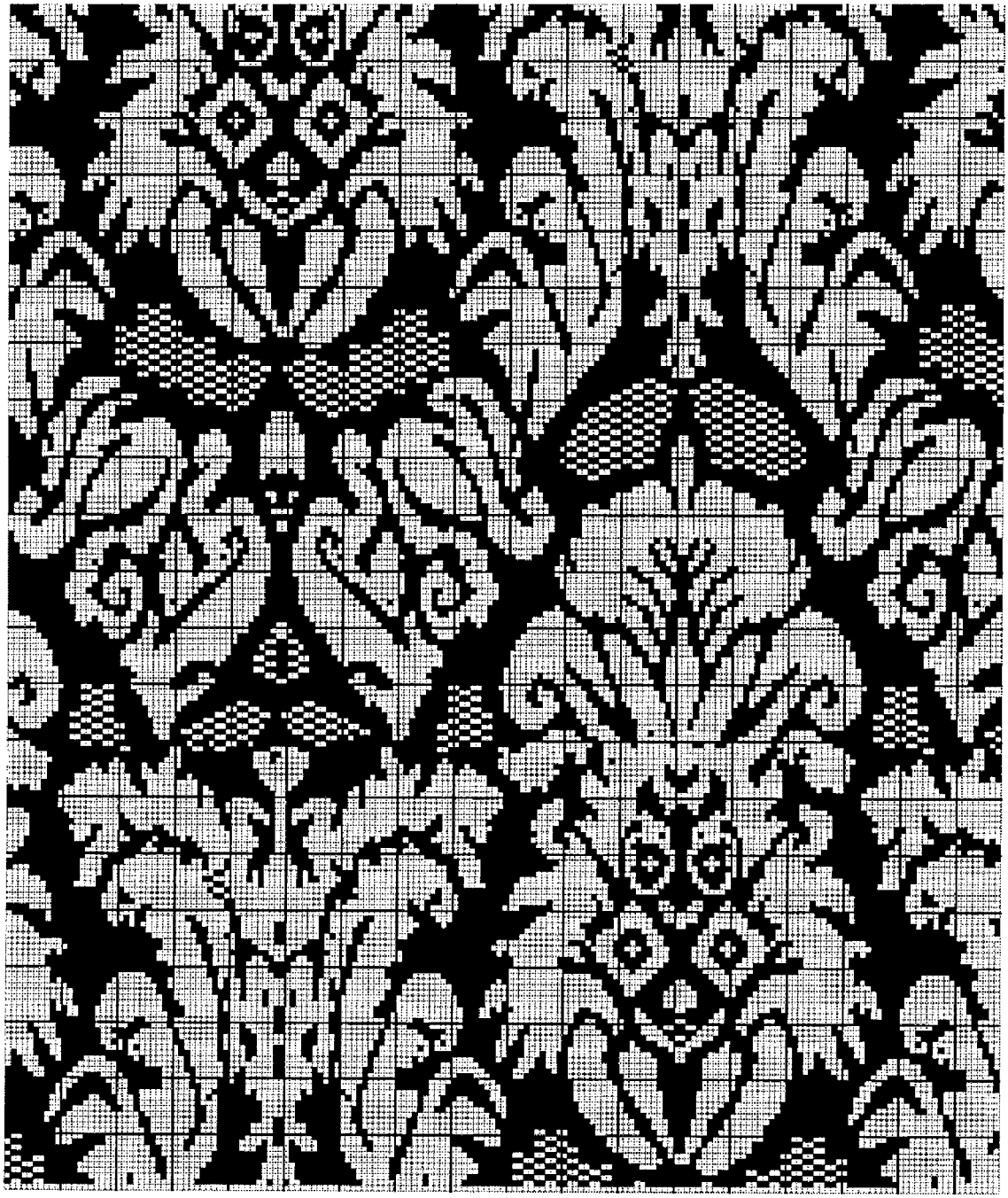
FIG. 5A is an illustration of an example scroll type pattern layout for use in the method of the present invention.
Figure 5B:
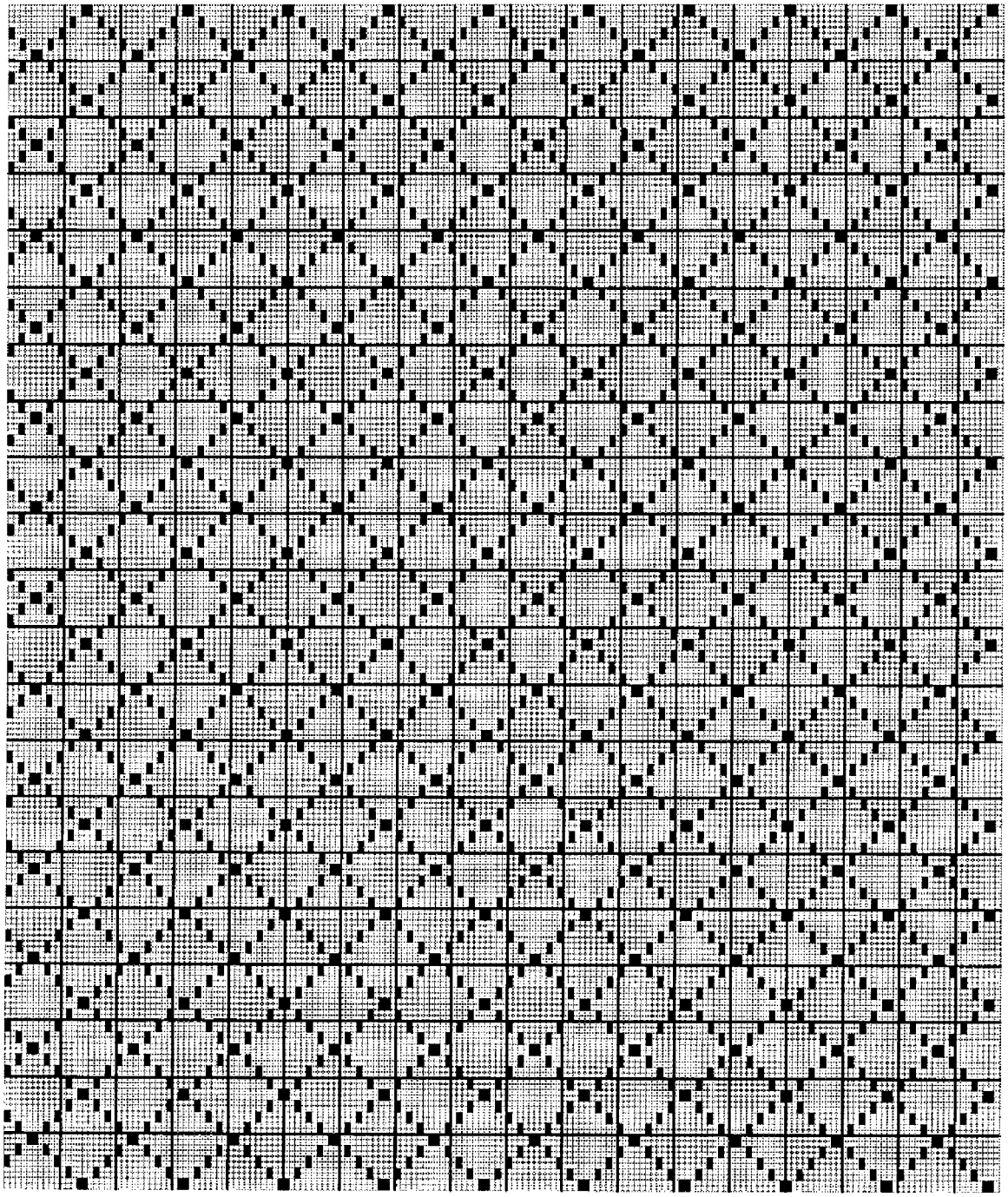
FIG. 5B is an illustration of a graphics type pattern layout for use in the method of the present invention.

Thereafter, in Step 102 (FIG. 4A), the operator will create a second pattern (Pattern 2), illustrated in the present embodiment as a shifting needle bar effect pattern such as a graphics pattern that can be a straight graphics or an "Enhanced Graphics" type pattern utilizing the stepping movement of the a shifting needle bar. This second pattern will be created on a second screen (Screen 2), after which the operator typically will set the size of the second pattern to be the same or a substantially equivalent size as the first pattern created, as indicated in Step 103. In addition, in Step 104, the operator or user can fill in the second pattern on Screen 2 with one or more colors that were not previously used in creating the first pattern of Screen 1. An example of a graphics pattern design created for Steps 102-104 is illustrated in FIG. 5B, which pattern generally comprises a diamond shaped pattern against a lighter-colored background. Thereafter, as indicated in Step 106 of FIG. 4A, the user will apply or draw in a "cam motion" or shift compensation for the steps calling for shifting of the needle bars according to the second pattern (Screen 2). Multiple colors also can be used to represent different pile heights of the tufts created during the shifting or cam motion of the pattern. In Step 107, the second pattern will be copied or duplicated as needed in Screen 2 so that the second pattern is fully repeated in both directions as needed to match the size and number of repeats for the first pattern of Screen 1. Typically, as shown in Step 108, the operator further will protect or fix the colors used for the shift compensation or "cam motion" in the steps of the second pattern.

Figure 5C:
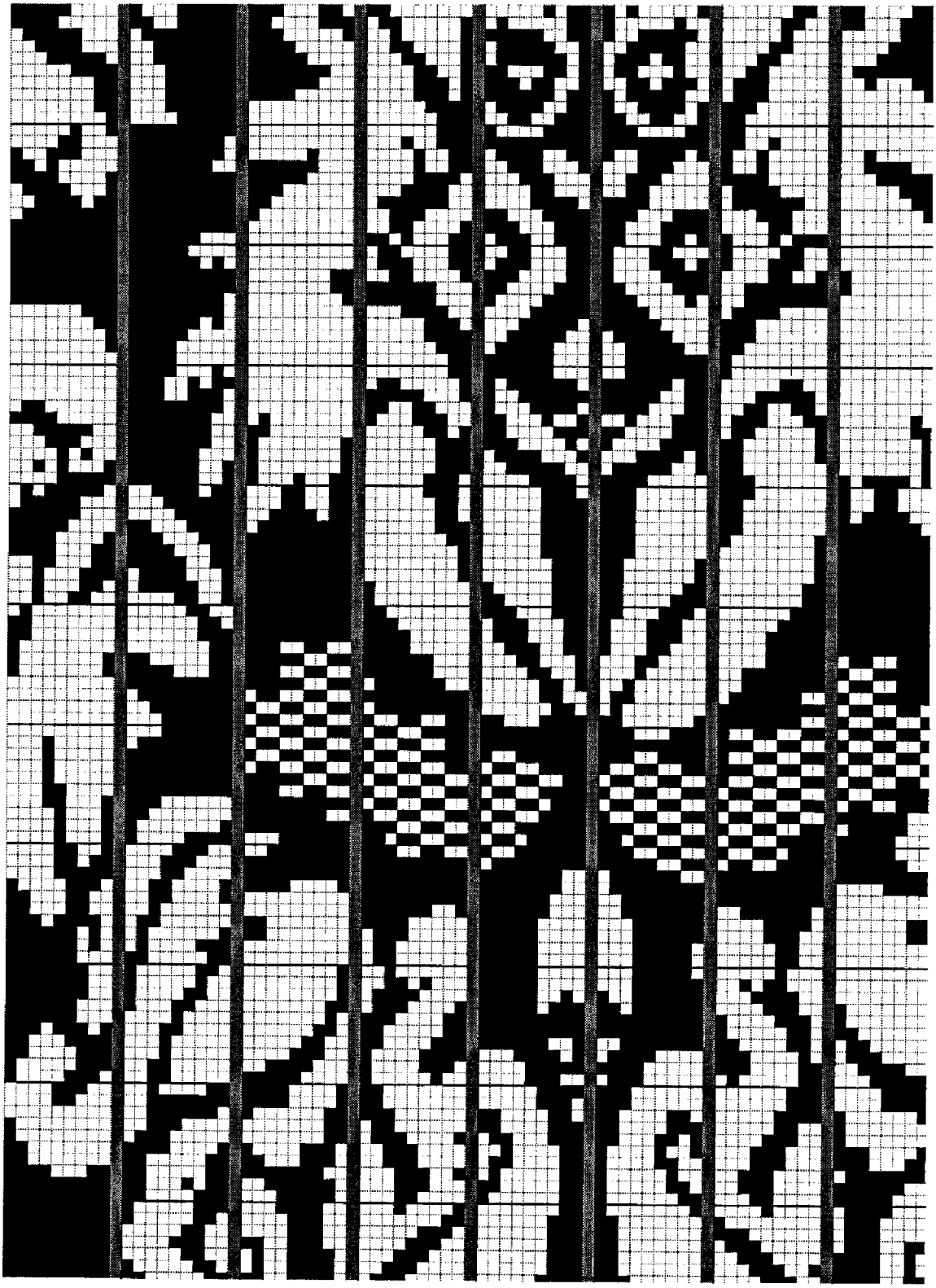
FIG. 5C is an illustration of the combined patterns of FIGS. 5A and 5B, according to the method of the present invention.
Figure 5D:
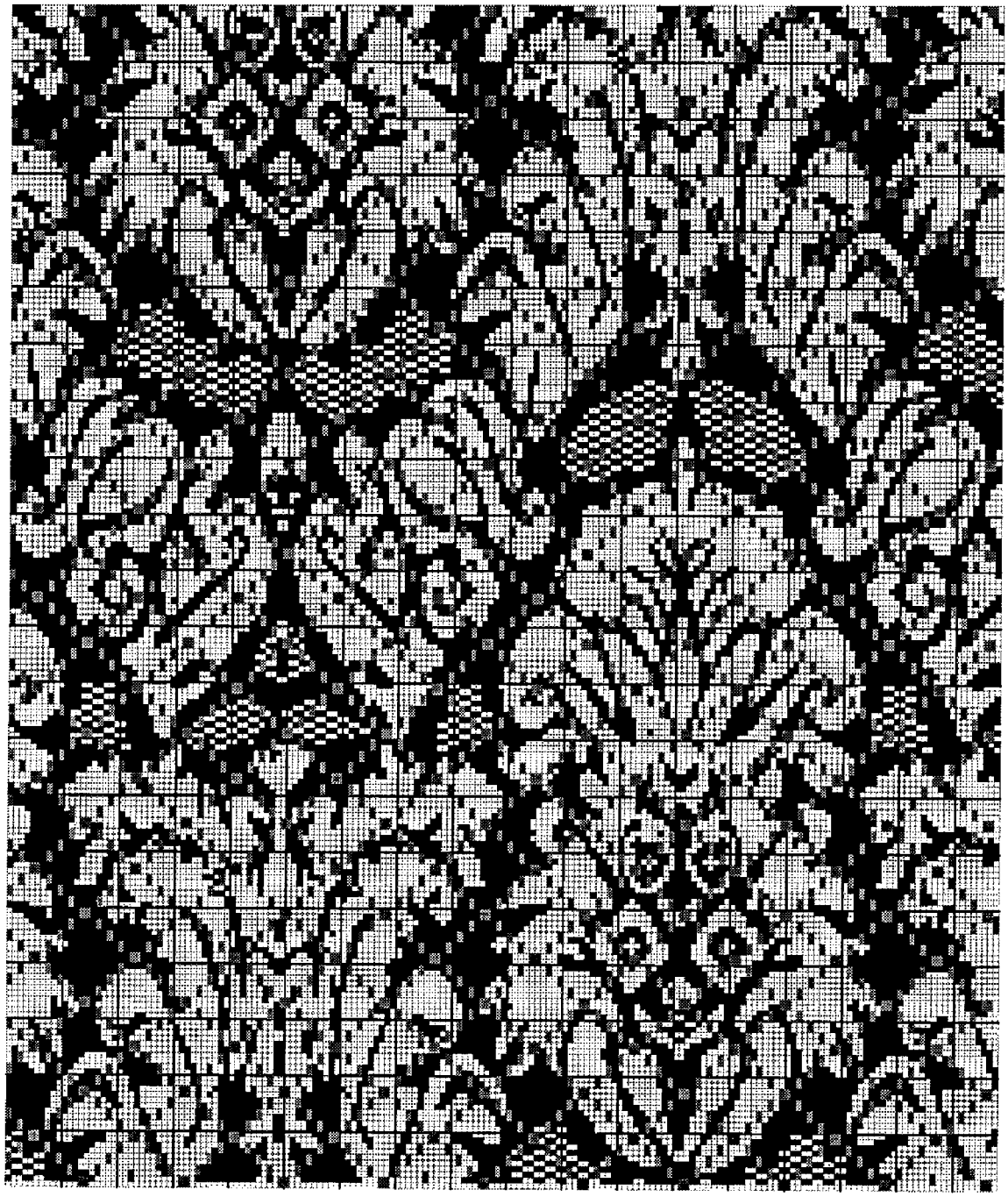
FIG. 5D is an illustration of a tufted article formed according to the method of the present invention.

In Step 109, the first pattern (Screen 1), which typically is the scroll or roll pattern or other similar yarn feed effect pattern, will be copied or merged into the second, graphics or shifting needle bar effects pattern of Screen 2. As a result, a combination pattern (pattern 3) is created, with the colors of the second graphics pattern created in Screen 2, which have been protected (such as the shift compensation steps) remaining visible. An example of such a combination pattern illustrating a scroll type pattern overlaid with shifting or cam compensation having been created/applied, indicated by the heavier vertically extending, straight lines, is illustrated in FIG. 5C. This combination pattern will be saved in Step 111, such as on the design center hard drive, or on a portable drive such as a disk, jump drive, or other portable storage media.

Figure 4A:
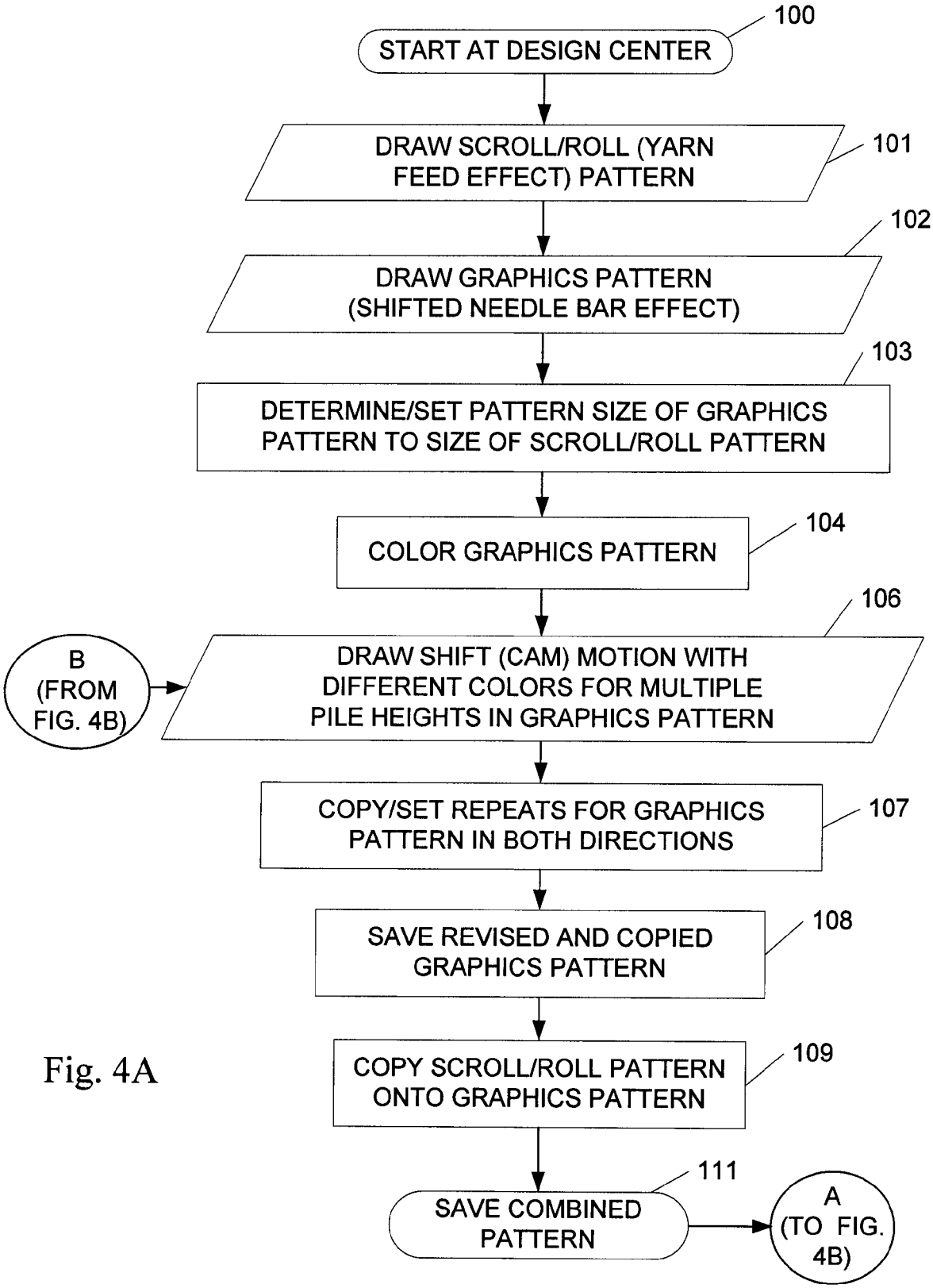
FIGS. 4A-4B are flow charts illustrating the method of operation of a tufting machine utilizing the present invention to form a tufted article with combined level cut loop and graphics pattern effects.
Figure 4B:
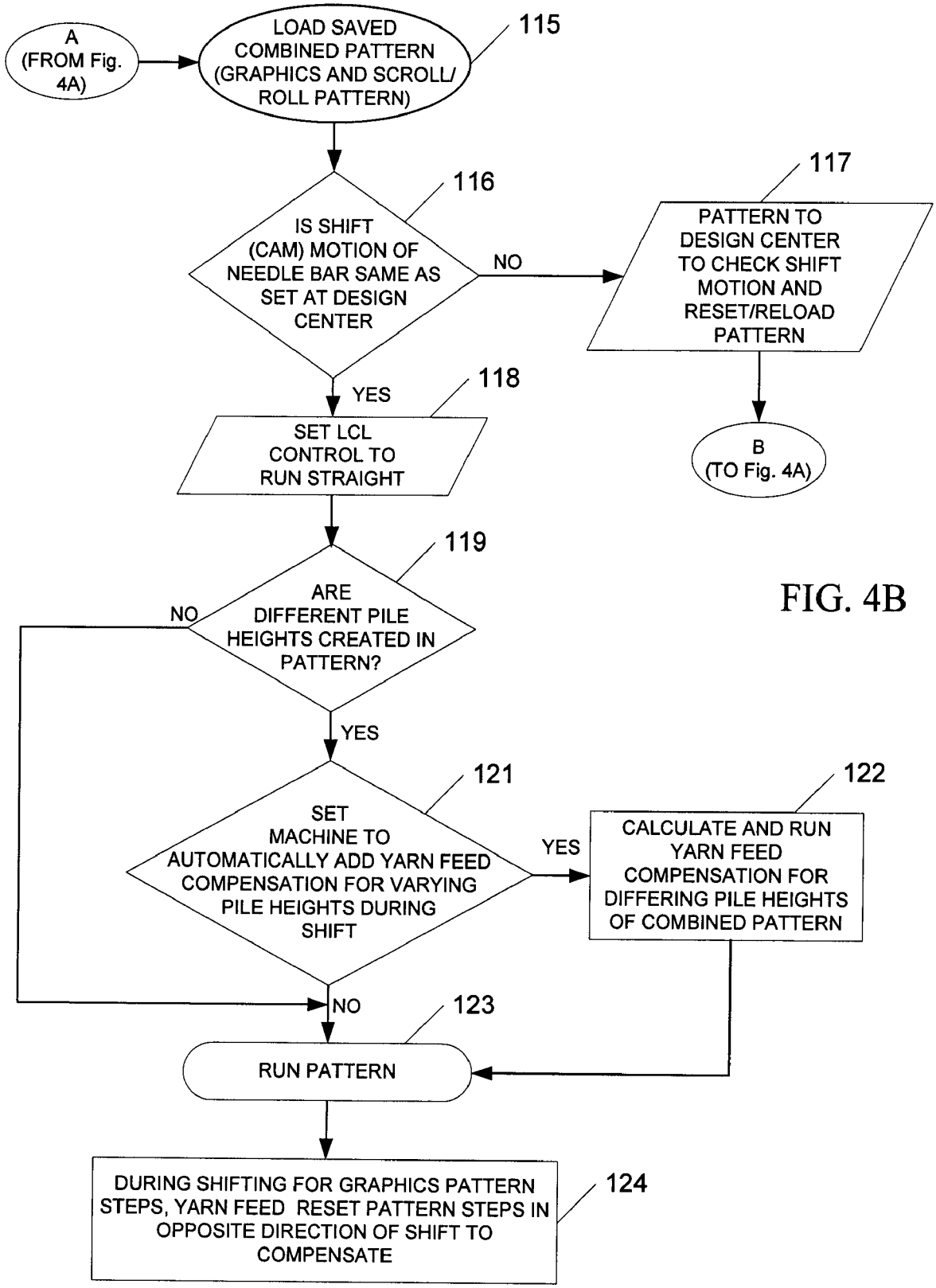

As indicated in FIG. 4B, in Step 115, the combination pattern (including, for example, the graphics or shifting needle bar pattern overlaid with a scroll or roll type yarn feed effect pattern, and with the cam motion or shift compensation having been applied) will be loaded into the control system for a tufting machine. The combination pattern (pattern 3) then can be transferred electronically directly from the design center, or can be downloaded from a portable media device or drive. After being loaded into the control system of the tufting machine, the control system will first check, in an initial Step 116, to ensure that the shifting motion of the needle bar or "cam motion" of the loaded combination pattern is the same as the stepping or shifting needle bar motion entered for the graphics pattern during creation at the design center. If not, the combination pattern should be returned to the design center to recheck the shift motion and reset or reload the shift motion for the combined pattern as indicated in Step 117. If the shift or "cam" motion of the combination pattern loaded in the tufting machine control system is correct, the tufting machine control settings for the operation of the level cut loop loopers 36 (FIG. 1) of the looper assembly 34 also can be programmed or set in Step 118 (FIG. 4B) to run straight, generally operating so as to track the operation of the graphics pattern (pattern 2) steps or commands.

In Step 119, the tufting machine control system generally will determine if different pile heights are being created in the pattern. If so, as indicated in Step 121, the operator is given the option to set the tufting machine controls to automatically add yarn feed compensation as needed or desired for such varying pile heights during the shifting of the needle bar. If so selected, in Step 122, the tufting machine control system thereafter will automatically calculate and run yarn feed compensation for the different pile heights of the combination pattern. If this option is not selected, or if different pile heights are not being created in the combined pattern, the tufting machine control system will then proceed to Step 123 and begin running the steps of the combination pattern.

During the running of the combination pattern (pattern 3), the tufting machine will run the scroll or yarn fed effect pattern straight until it reaches a step in the combination pattern calling for a shift of the needle bar(s) in accordance with the underlying graphics pattern (pattern 2). At such a point, the tufting machine control system will be programmed to effectively split the combination pattern back into the two underlying patterns (pattern 1 and pattern 2), running at a slight delay in operating the pattern steps thereof. The control system automatically will apply pattern compensation to the yarn feed step or command of the underlying yarn feed effect pattern (pattern 1) so as to effectively shift the operation of the scroll or roll yarn feed effect pattern steps/commands (pattern 1 steps) in the opposite direction from the direction of the shifting of the needle bar according to the graphics pattern steps (pattern 2 steps) to keep the combination pattern effectively running straight. For example, if the needle bars shifted to the left, the yarn feed pattern step or command to be run is changed to be run for different needles in that zone (i.e., where the needles are shifted to a "low pile/tuft zone," the yarn feed for all of the needles landing in that particular zone is changed to run a low yarn feed).

In addition, the level cut loop looper or hook assembly 34 (FIG. 1) effectively will be run at different or delayed steps whereby the operation of the level cut loopers can be changed or controlled to compensate for and follow the shifting of the needle bar. Thus, where the needles shift and the yarn feed is shifted so that the needles in a particular zone are forming low loop tufts, the level cut loop loopers can be operated to cause their clips to be moved forwardly and engage and urge the loops off of the level-cut-loop loopers to form the low pile loop tufts as desired. Further, where the needles are staggered in an "AB stagger" on an inline needle bar, the operation of the level cut loop loopers likewise can be internally shifted or adjusted to follow the needle bar shift to follow a particular color (i.e., the operation of level cut loop loopers can be controlled to run cut pile to ensure that cut pile or loop pile tufts are run for a particular color for the whole pattern).

Accordingly, the present invention enables the formation of tufted articles that can combine a variety of pattern effects or looks that typically had been run on the same or different types of tufting machines. For example, the present invention enables the formation of various scroll or roll patterns combined with graphics or enhanced graphics patterning effects and/or level cut loop pattern effects, enhanced graphics patterns with level-cut-loop pattern effects, and/or a variety of other types of patterns to expand and enhance the ability of the tufting machine to run a wider variety of tufted patterns, including the pattern control systems or attachments incorporated with the tufting machine.

It will be further understood by those skilled in the art that while the present invention has been described above with reference to preferred embodiments, numerous variations, modifications, and additions can be made thereto without departing from the spirit and scope of the present invention as set forth in the following claims.

What is claimed:

1. A method of controlling a tufting machine to form tufts of yarn in a backing material passing through the tufting machine, to form tufted articles having a combination of varied pattern effects, the method comprising:

creating a yarn feed effect tufting pattern having a first design;

creating a shifting needle bar effect tufting pattern of a second, different design;

determining and applying shift compensation for pattern steps of the shifting needle bar effect tufting pattern to create a revised shifting needle bar effect tufting pattern;

merging the yarn feed effect tufting pattern into the revised, shifting needle bar effect tufting pattern and creating a combination tufting pattern;

loading the combination tufting pattern into a control for the tufting machine;

moving the backing material through the tufting machine and reciprocating a needle bar carrying a series of needles therealong into the backing material to form the tufts of yarn therein according to steps of the combination tufting pattern;

when the combination tufting pattern calls for shifting of the needle bar, splitting the combination pattern into separate pattern steps of the underlying first and second patterns for yarn feed control and shifting, respectively; and adjusting the yarn feed to compensate for shifting in the combination tufting pattern and keep the combination tufting pattern running substantially straight.

2. The method of claim 1 and wherein creating the yarn feed effect tufting pattern comprises creating a roll or scroll pattern.

3. The method of claim 1 and wherein creating a shifting needle bar effect tufting pattern comprises creating a graphics type pattern.

4. The method of claim 1 and wherein adjusting the yarn feed to compensate for shifting comprises internally shifting the pattern yarn feed opposite the movement of the shifting of the needle bar.

5. The method of claim 1 and wherein creating the yarn feed effect pattern comprises creating a level cut loop pattern.

6. The method of claim 5 and further comprising setting the level-cut-loop pattern to run straight during shifting.

7. The method of claim 1 and further comprising adding yarn feed shift compensation for varying pile heights of the tufts during shifting of the needle bar.

8. The method of claim 1 and further comprising copying the revised shifting needle bar effect pattern to create pattern repeats for the revised shifting needle bar effect pattern.

9. A method of forming a tufted pattern, comprising:

drawing a yarn feed effect pattern;

drawing a shifting needle bar effect pattern;

applying shift compensation for pattern steps of the shifting needle bar effect pattern involving shifting of the needle bar and copying the yarn feed effect pattern into the shifting needle bar effect pattern to create a combination pattern;

moving a backing material through a tufting zone of a tufting machine and reciprocating a series of yarn carrying needles into the backing material to form tufts of yarn therein according to the combination pattern;

for steps of the combination pattern requiring shifting of the needle bar, running corresponding steps of the underlying needle bar effect and yarn feed effect patterns separately; and adjusting feeding of the yarns in accordance with the yarn feed effect pattern step to compensate for the shifting of the needle bar so that the combination pattern is effectively run straight.

10. The method of claim 9 and wherein creating the yarn feed effect tufting pattern comprises creating a roll or scroll pattern.

11. The method of claim 9 and wherein creating a shifting needle bar effect tufting pattern comprises creating a graphics type pattern.

12. The method of claim 9 and wherein adjusting the yarn feed to compensate for shifting comprises internally shifting the yarn feed required by the underlying yarn feed effect pattern step opposite the movement of the shifting of the needle bar.

13. The method of claim 9 and further comprising controlling a level cut loop looper assembly of the tufting machine to run straight during shifting of the needle bar.

14. The method of claim 9 and further comprising controlling the operation of a level cut loop looper assembly to shift in accordance with the shifting of the needle bar.

15. The method of claim 9 and further comprising adding yarn feed shift compensation for varying pile heights of the tufts during shifting of the needle bar.

* * * * *